US010538354B2

(12) United States Patent
Hannen et al.

(10) Patent No.: US 10,538,354 B2
(45) Date of Patent: Jan. 21, 2020

(54) METHOD AND APPARATUS FOR WRAPPING A FILM AROUND AN OBJECT

(71) Applicants: Reiner Hannen, Kalkar-Wissel (DE); Norbert Vermeulen, Kleve-Warbeyen (DE)

(72) Inventors: Reiner Hannen, Kalkar-Wissel (DE); Norbert Vermeulen, Kleve-Warbeyen (DE)

(73) Assignee: MSR-VERPACKUNGS-SYSTEME GMBH, Kleve (DE)

( * ) Notice: Subject to any disclaimer, the term of this patent is extended or adjusted under 35 U.S.C. 154(b) by 647 days.

(21) Appl. No.: 14/096,265

(22) Filed: Dec. 4, 2013

(65) Prior Publication Data

US 2014/0157724 A1 Jun. 12, 2014

(30) Foreign Application Priority Data

Dec. 6, 2012 (EP) ..... 12195912

(51) Int. Cl.

| | |
|---|---|
| ***B65B 53/02*** | (2006.01) |
| ***B65B 51/20*** | (2006.01) |
| ***B65B 53/06*** | (2006.01) |
| ***B65B 11/58*** | (2006.01) |
| *B65B 9/13* | (2006.01) |

(52) U.S. Cl.

CPC ..... *B65B 53/02* (2013.01); *B65B 11/585* (2013.01); *B65B 51/20* (2013.01); *B65B 53/066* (2013.01); *B65B 9/135* (2013.01)

(58) Field of Classification Search

CPC ..... B65B 53/02; B65B 51/20
USPC ..... 53/442
See application file for complete search history.

(56) References Cited

U.S. PATENT DOCUMENTS

| | | | | |
|---|---|---|---|---|
| 3,495,375 | A * | 2/1970 | Burhop | B65B 51/14 206/499 |
| 3,514,920 | A * | 6/1970 | Hoffler | B65B 11/045 53/214 |
| 3,621,588 | A * | 11/1971 | Grocke | B65B 53/06 34/65 |
| 3,640,048 | A * | 2/1972 | Zelnick | B65B 9/026 206/386 |
| 3,662,512 | A | 5/1972 | Zelnick | |
| 3,667,598 | A | 6/1972 | Zelnick et al. | |
| 3,840,997 | A * | 10/1974 | Lucas | B65B 53/063 34/66 |

(Continued)

FOREIGN PATENT DOCUMENTS

WO 00/53497 A1 9/2000

*Primary Examiner* — Chelsea E Stinson
(74) *Attorney, Agent, or Firm* — Andrew Wilford

(57) ABSTRACT

An object is first wrapped with a strip of thermoplastic film such that upper edges of the strip project upward past a top face of the object and fold inward onto outer edge regions of the top face of the object. Then a cover sheet is laid on the top face over the folded-in edges of the strip with outer edges of the cover sheet projecting outward past and hanging down around the wrapped object outside the film strip. A heated plate is then pressed down against the cover sheet and hot air is blown against the strip on the side faces so as to shrink the strip against the side faces and such that the hot air rises and welds the outer cover-sheet edges sheet to the strip around upper regions of the side faces.

8 Claims, 2 Drawing Sheets

(56) References Cited

U.S. PATENT DOCUMENTS

| | | | | | |
|---|---|---|---|---|---|
| 3,853,218 | A * | 12/1974 | Grasvoll | B65B 9/026 | 206/497 |
| 3,893,279 | A * | 7/1975 | Bostrom | B65B 11/585 | 53/176 |
| 3,897,671 | A * | 8/1975 | Higgins | B65B 53/063 | 34/222 |
| 3,930,790 | A * | 1/1976 | Rogosch | B65B 53/02 | 432/229 |
| 3,956,867 | A * | 5/1976 | Utz | B65B 9/04 | 426/412 |
| 4,098,051 | A * | 7/1978 | Cordes | B65B 53/02 | 53/258 |
| 4,538,363 | A * | 9/1985 | Zagoroff | F26B 25/008 | 34/225 |
| 4,651,508 | A * | 3/1987 | Hannen | B65B 53/066 | 53/442 |
| 4,866,916 | A * | 9/1989 | Hannen | B65B 53/066 | 53/557 |
| 5,596,866 | A * | 1/1997 | Martin-Cocher | B65B 53/066 | 53/442 |
| 5,819,503 | A * | 10/1998 | Lancaster, III | B65B 11/585 | 53/176 |
| 6,648,634 | B2 * | 11/2003 | Nava | B65B 53/063 | 432/121 |
| 7,703,263 | B2 * | 4/2010 | Reiner | B65B 59/00 | 53/218 |
| 8,191,341 | B2 * | 6/2012 | Ours | B65B 1/02 | 53/399 |
| 2002/0033002 | A1 * | 3/2002 | Lachenmeier | B65B 53/066 | 53/442 |
| 2008/0202072 | A1 * | 8/2008 | Reiner | B65B 53/066 | 53/442 |

* cited by examiner

METHOD AND APPARATUS FOR WRAPPING A FILM AROUND AN OBJECT

FIELD OF THE INVENTION

The present invention relates to a packaging system. More particularly this invention concerns a method of and apparatus for wrapping a film around an object, for instance a stack of packages on a pallet.

BACKGROUND OF THE INVENTION

The term product stack refers, in particular, to a plurality of packaging types, packages, bags, or the like that are preferably combined or stacked to create a rectangular product stack. The stack is typically formed on a pallet, but it is in principle also possible to apply the inventive method to a product stack without a pallet. Furthermore, the object being wrapped according to the invention can be a product stack formed of only a few stacked items, or even an individual larger item, such as, for example, those from the white goods sector (washing machines, refrigerators, dishwashers, and the like). The scope of the invention furthermore comprises the fact that the film is of plastic, and preferably a shrinkwrap film composed of plastic that can be shrunk onto the product stack under the action of heat. This enables the item(s) in the product stack to be held tightly together, and, in particular, secured against slipping out of position or the like.

A variety of such wrapping methods are known in practice. Based on their various loading formats for the product stack, the paper industry, for example, wraps packages as follows. A film cover sheet is first placed on the top of the product stack so as to project by 100 mm to around 300 mm down below the horizontal upper surface of the product stack. A film strip is then wrapped around the vertical sides of the product stack, which strip encloses the projecting film segments of the film cover sheet. An edge of the film strip typically projects 50 mm to 400 mm wide beyond the top face of the product stack. A following step then involves welding the upwardly projecting edge of the film strip down onto the film cover sheet. In another known procedural approach, the film strip is first placed around the product stack, the outwardly projecting edges are folded down over the top face of the product stack and secured there. The film cover sheet is then applied and welded in a further step to the folded-in edges of the film strip.

Both of the above-described procedures have disadvantages. The folded-in edges of the film strip are folded in three layers, in particular, at the corners of the product stack and can thus be heated only slowly and incompletely during the welding process. This creates unsealed folds and capillaries, with the result that water can get under the film cover sheet from the side. Paper products especially can become covered with mold as a result. In addition, air can also be trapped between the film cover sheet and the folded-in edges of the film strip, thereby allowing bubbles to form that can tear open during the stacking action and enable water to enter.

OBJECTS OF THE INVENTION

It is therefore an object of the present invention to provide an improved method and apparatus for wrapping a film around an object.

Another object is the provision of such an improved method and apparatus for wrapping a film around an object that overcomes the above-given disadvantages, in particular that avoids the above-described disadvantages an functionally reliable and effective way.

A further object of the invention is to provide an apparatus for carrying out this method.

SUMMARY OF THE INVENTION

A method of shrink packaging an object having side faces and a top face starts with the step of wrapping a strip of thermoplastic film around the side faces of the object such that upper edges of the strip project upward past the top face of the object and fold inward onto outer edge regions of the top face of the object. Then a cover sheet of thermoplastic film is laid on the top face of the object over the folded-in edges of the strip with outer edges of the cover sheet projecting outward past and hanging down along upper edge regions of the side faces of the object outside the film strip. A heated plate is then pressed down against the cover sheet to flatten same and the folded-in edges of the strip against the top face and hot air is blown against the strip on the side faces so as to shrink the strip against the side faces and such that the hot air rises and welds the outwardly projecting outer edges of the cover sheet to the strip around upper regions of the side faces. The object is preferably a rectangular product stack having four planar sides, a planar top face, and a planar bottom side.

The scope of the invention comprises the fact that the film strip and the film cover sheet are thermoplastic heat-shrink. The scope of the invention furthermore comprises the fact that film strip is shrunk onto the product stack under the action of heat. The film strip can be a section of film that is wrapped around the sides of the product stack, the two ends of the strip being joined, preferably by welding. In another embodiment, the film strip can also relate to a film tube or a film hood that is pulled over the product stack.

According to the invention the edges of the strip projecting upward and folded inward on the top face have a width between 50 and 400 mm, and the edges of the cover sheet that project outward past and eventually lie against the strip on upper regions of the side faces have a width between 100 and 300 mm. Whenever reference is made to the film cover sheet of the outwardly projecting edges, this also means within the scope of the invention the film edges that hang down along the sides of the product stack.

The operation preferably according to the invention preferably uses a heated or temperature-controlled press plate. It is recommended that the press plate be heated or temperature-controlled to a temperature that is below the melting temperature of the material or plastic of the film cover sheet. Advantageously, the cover sheet is only preheated by the press plate. In a preferred embodiment of the invention, the press plate is pressed onto the film cover sheet in order to force or press out air from the folded-in edges of the film strip between the top face on one side the outwardly projecting edges and the film cover sheet on the other. This prevents formation of the above-described disadvantageous air pockets on the top face of the product stack. These air pockets can form especially at the corners of the product stack at which the projecting edges are typically folded-over in three layers or onto the top face.

It is recommended that a press plate be utilized that projects horizontally outward beyond the top corner edges of the product stack. The press plate is thus of greater area than the top face of the product stack and greater than the film cover sheet resting on the top face of the product stack. In principle, the area of the press plate can also the same as the area of the film cover sheet. An especially preferred embodiment of the invention is characterized in that the press plate constitutes the closed top wall or ceiling of a shrinking chamber having side walls that extend along the side faces of the product stack. They direct and guide hot air upward in the shrink chamber toward the top face of the product stack or toward the press plate. According to the invention the press plate creates closes the top of the shrink chamber pressed onto the top face of the product stack. The invention furthermore comprises the approach the shrink chamber extends around the perimeter of the product stack. In a recommended embodiment of the invention, the side walls of the shrink chamber are each composed of side wall parts that vertically telescope. This enables the vertical size of the side walls to be easily adjusted to the height of the product stack. The top wall part of the vertically telescoping side wall parts are advantageously attached to the press plate.

In accordance with the invention the upper regions of the film strip are heated by the rising hot air, thereby enabling these heated strip regions to weld to the heated edges of the film cover sheet. Thus simultaneous heating advantageously occurs in the upper region of the product stack both for edges regions of the film cover sheet and of the strip. An optimally impervious or watertight weld can thus be achieved between the film cover sheet and the film strip.

A recommended embodiment of the method according to the invention is characterized in that the film regions initially hanging down along the upper edges of the product stack are lifted by the rising hot air, then fall back along the sides of the product stack as a consequence of being heated up by it and are advantageously welded there to the heated strip. The lifted film regions in other words loose their stability due to being heated up and thus fall back along the sides of the product stack where they weld to the heated upper strip regions. The invention is based here on the idea that a partial vacuum is created at the top face of the edges of the lifted film cover sheet. This partial vacuum causes the film edges to remain in the lifted position for a relatively long time during which they can be heated up effectively. The regions contract toward the product stack when the film regions are heated or heated up. Due to this shrink effect, the area/weight ratio of the regions is changed. Nevertheless, the film regions continue to remain in the lifted position due to the generated partial vacuum until they become, as it were, "doughy" and fall back along the sides of the product stack due to their loss of stability where they are also welded to the strip regions that are also heated.

The hot air rising according to the invention along the sides of the product stack is generated by a hot-air shrink frame that surrounds the sides of the product stack. Advantageously, the hot air shrink frame is preferably moved vertically into a position in which the hot air rising from the hot air shrink frame can effectively heat the film regions of the film cover sheet or the upper strip regions for welding. The hot air shrink frame is spaced with sufficient horizontal clearance or horizontal safety margin from the sides of the product stack. The film strip is furthermore according to the invention shrunk by the hot air shrink frame onto the product stack or onto the sides of the product stack. This shrinking onto the sides of the product stack is also called "side shrink."

It is recommended that the hot air shrink frame be moved downward along the sides of the product stack after the projecting edges of the film cover sheet have been heated or after the upper strip regions have been heated. The hot air shrink frame here is advantageously moved down at a sufficiently high speed for the remaining air to be moved downward and out of the space between film strip and product stack. It is recommended that following this a floor film of the product stack be welded by the hot air shrink frame to the film strip. This floor film is between the pallet and the product stack. Welding the film strip to the floor film is also identified as "undershrink."

Provision is made in an alternative embodiment of the invention where the position of the hot air shrink frame for the "undershrink" action or for welding the floor film to the film strip also corresponds to the position of the shrink frame for generating the hot air to lift the film cover sheet or to weld the film regions of the film cover sheet to the strip regions. This embodiment is recommended, in particular for low-profile product stacks.

An embodiment that has proven especially successful is characterized in that the press plate is lifted when the film strip is shrunk onto the sides of the product stack (side shrink) or when the film strip is welded to the floor film (undershrink), with the result that the film cover sheet or the top face of the film cover sheet is heated by the rising hot air. Lifting the press plate essentially causes a heating space to be generated over the product stack or over the film cover sheet. The described heating of the film cover sheet or of the top face of the film cover sheet is preferably effected so as not to allow any welding of the film cover sheet to the folded-in edges of the film strip. The point in time when the press plate is lifted during the procedure is selected as governed the above condition. The film cover sheet is then cooled so as to rest taut and without welding over the folded-in edges of the film strip. A flat surface is then created on the product stack, thereby preventing water or other liquid from easily accumulating here. As a result, this embodiment is distinguished by a significant advantage over the known methods described above.

The object of the invention is also an apparatus for applying a film over a product stack, in particular for shrinking-on a film or shrinkwrap film onto a product stack. It has means for applying a film strip on the sides of the product stack and a press plate to press a film cover sheet onto the top face of the product stack and onto the folded-in edges of the film strip. Furthermore means is provided for generating hot air that rises along the sides of the product stack in order to weld the protruding film regions of the film cover sheet to the upper strip regions.

The invention is based on the idea that the above-described disadvantages can be effectively and functionally reliably prevented by the method according to the invention and by the apparatus according to the invention. In particular leaks can be effectively reduced in the area of the top face of the product stack or between the film cover sheet and projecting edges of the film strip. As a result, water cannot reach the product stack from the side underneath the film and cause damage to the product, such as, for example, generating mold. In addition, disadvantageous air pockets can also be prevented and considerably reduced by the method according to the invention. The method according to the invention can also implemented using a simple and low-cost approach. The apparatus according to the invention is characterized by a simple design that is of low is complexity.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
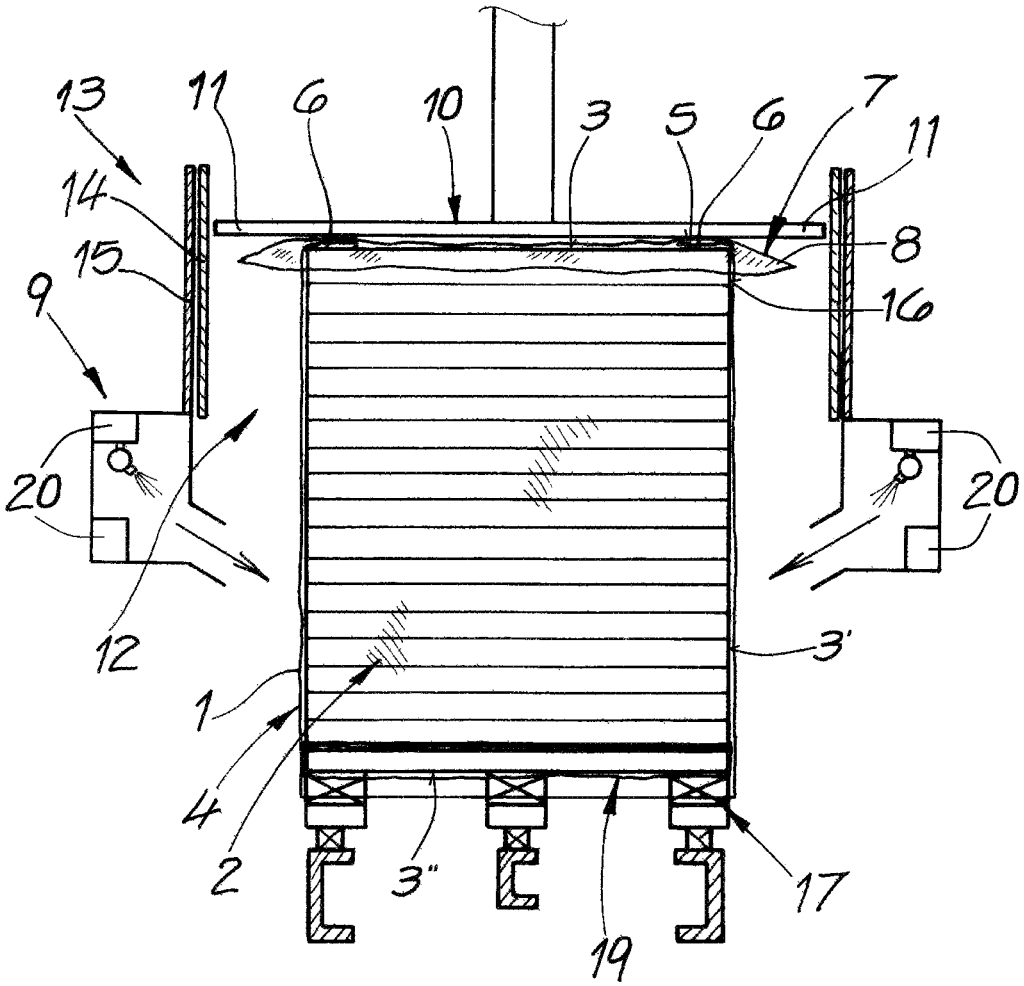
FIG. 1 is a side view of an apparatus according to the invention t the start of the wrapping process.
Figure 2:
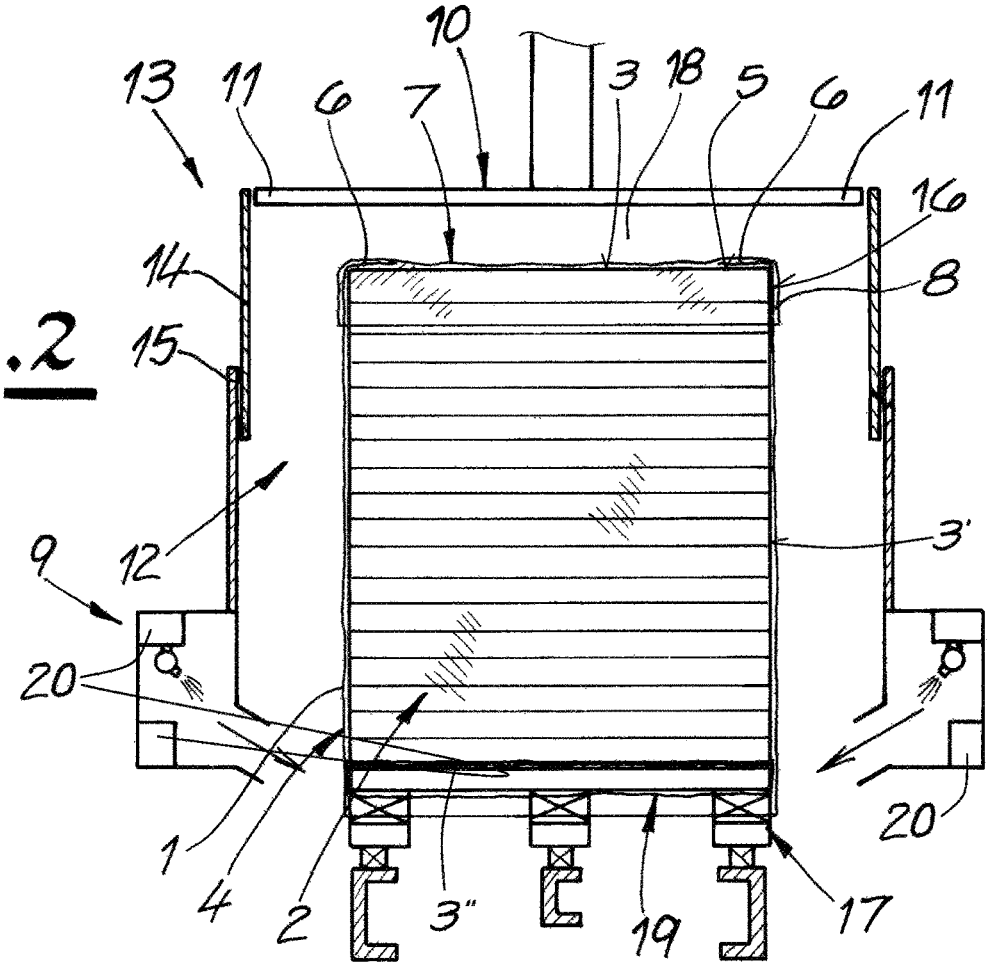
FIG. 2 is a side view of the apparatus toward the end of the wrapping process.
Figure 3:
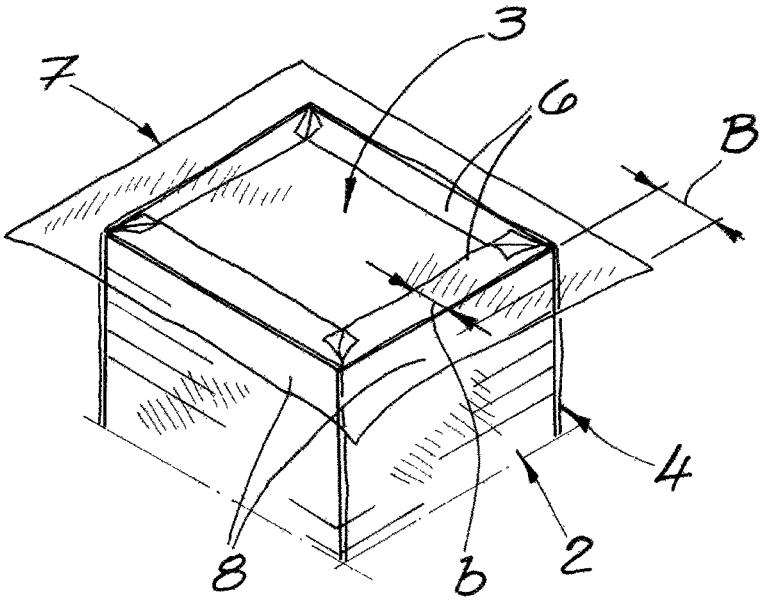
FIG. 3 is a perspective top view of the wrapped object.

As seen in FIGS. 1 and 2 an apparatus according to the invention shrinks a film 1 onto an object or product stack 2 that in the illustrated preferable form is rectangular with a top face 3, four side faces 3', and a bottom face 3". A heat-shrinkable film strip 4 is first wrapped around the side faces 3' of the stack 2. The strip 4 is wound so that edges 6 project up past top edge regions 16 of the side faces 3' of the stack 2, where they fold of their own accord over onto outer edge regions 5 of the top face 3. A film cover sheet 7 is then placed on the top face 3 of the stack 2 over the folded-over edges 6 of the strip 4. The cover sheet 7 here itself has edges 8 that project laterally outward past the top edge region 5 of the stack 2 and hang down by gravity along upper side edge regions 16. Here the strip 4 is preferably shrunk onto the stack 2 or onto the side faces 3' of the stack 2 by use of a hot-air shrink frame 9. As shown, the shrink frame 9 may comprise a plurality of heaters 20 that are distributed around its perimeter and heat the strip 4 to shrink it tightly onto the stack 2.

Preferably here the method according to the invention comprises first moving the shrink frame 9 vertically to a center position as shown in FIG. 1, roughly vertically midway between the top face 3 and bottom face 3". This action presses a temperature-controlled press plate 10 down onto the top face 3 of the stack 2 or onto the film cover sheet 7 lying thereon.

Advantageously the press plate 10 is heated or heated in controlled fashion to a temperature that is below the melting temperature of the plastic of film cover sheet 7 but above its softening temperature. Preferably, the press plate 10 is pressed onto the film cover sheet 7 in such a way that air is forced out laterally from between the sheet 7 and the top face 3 of the stack 2, exiting from the folded-over edges 6 of the strip 4, or this air is forced out from between the edges 6 and the cover sheet 7. Preferably, the press plate 10 has an all-around outer edge region 11 that projects on all four sides of the stack 2 beyond the upper edges 5 of the stack 2.

Advantageously, the press plate 10 and its edge regions 11 form a closed top wall of a substantially upwardly and laterally closed shrink chamber 12 that has side walls 13 that each extend parallel to a respective side face 3' of the stack 2. Preferably, these side walls 13 are each formed by at least two vertically telescoping side-wall parts 14 and 15. The upper wall parts 14 here advantageously extend up to the press plate 10, and the lower wall parts 15 of the side walls 13 preferably are connected to the shrink frame 9 and can be moved together with it. This enables the shrink chamber 12 to be variably adapted to product stacks 2 of different heights.

Hot air is generated in the center position of the shrink frame 9 as shown in FIG. 1 so that this hot air rises inside the chamber 12 along the four side faces 3' of the stack 2. The position here of the shrink frame 9 is such that the downwardly hanging film edges 8 of film cover sheet 7 are also heated by the rising hot air in the same way as upper portions of the strips 4 that contact the sides 3' of the stack 2, with the result that the film edges 8 along the sides 3' of the stack 2 are welded or bonded at upper regions 16 of the side faces 3' to the strip 4. The cover-film edges 8 are therefore welded all around to the film 4 covering the side faces 3' of the object 2 so that the object 2 is completely enclosed and, in fact, waterproof from above.

Preferably, the shrink frame 9 is then moved downward on the stack 2 as shown in FIG. 2. The shrink frame 9 here is moved down at sufficiently high speed for air to be pressed down and out of the space between the strip 4 and the side faces 3' of the stack 2. The drawing further shows that the stack 2 is preferably sitting on a pallet 17. Preferably, welding is effected between the strip 4 and another thermoplastic floor film 19 that lies between the pallet 17 and the stack 2 (the so-called undershrink) in the lower position shown in FIG. 2 for the shrink frame 9 with in fact outer edges of the floor film 19 hanging down like the edges 8 to be pressed against and bond inwardly to side faces of the pallet 19 and outwardly to the windings or winding of the film 4. The shrink frame 9 then travels back upward to effect a shrinking-on or secondary shrinking-on of the strip 4 along the sides 3' of the stack 2. The shrinking-on of the strip 4 can, however, also occur only as the shrink frame 9 travels down along the stack 2. The shrinking-on of the strip 4 onto the sides of the stack 2 is also referred to as side shrink.

Preferably, the press plate 10 that was pushed down onto the top face 3 of the stack 2 is moved upward (FIG. 2) during the undershrink, that is the movement downward from the middle position of FIG. 1 to the lower position of FIG. 2. A space 18 is thus created between the press plate 10 and film cover sheet 7 that has been previously brought to temperature by the press plate 10, into which space 18 the rising heated air can penetrate. As a result, the film cover sheet 7 is heated further. Heating of the film cover sheet 7 is advantageously effected with such low heat that no welding occurs of it to the folded-over edges 6 of the strip 4. During the subsequent cooling, the film cover sheet 7 is tensioned relatively tautly over the top face 3 of the stack 2, thereby creating an advantageous flat surface on which no detrimental accumulations of water or water puddles can form.

A width b of the edges 6 of the strip 4 may preferably range between 50 mm and 400 mm. A width B of the film edges 8 of the film cover sheet 7 may range between 100 mm and 300 mm.

We claim:

1. A method of shrink packaging an object having outwardly directed side faces and an upwardly directed top face, the method comprising the steps of sequentially:

wrapping a strip of thermoplastic film around the side faces of the object such that an upper edge of the strip projects upward past the top face of the object and folds inward onto outer edge regions of the top face of the object;

laying a cover sheet of thermoplastic film on the top face of the object over the folded-in upper edge of the strip with an outer edge of the cover sheet projecting outward past and hanging down outside the film strip along upper edge regions of the side faces of the object;

forming a downwardly open and downwardly extendable shrinking chamber between a vertically shiftable heated plate having outer edges and a plurality of vertically extendable side walls movable independently of the plate, extending downward from the outer edges along and spaced horizontally outwardly from respective side faces of the object, and having lower ends carrying an annular shrink frame vertically displaceable with the walls;

moving the plate, walls, and shrink frame down over the object wrapped in the strip of film and cover sheet to enclose the top face and to press the heated plate down against the cover sheet to flatten same and the folded-in upper edge of the strip against the top face;

maintaining the plate at a temperature sufficient to soften the cover sheet but below a melting point of the cover sheet such that the cover sheet is heated by the plate only to a temperature sufficient to soften the cover sheet but not to melt and weld the cover sheet to the top face; and thereafter, while holding the cover sheet down on the top face with the heated plate, blowing hot air from the shrink frame between the side faces and the side walls of the chamber while the walls are moving downward from an upper position with the shrink frame level with the upper regions of the side faces so as to first lift the outwardly projecting edge of the cover strip, then, as the walls and shrink frame move downward to a lower position with the shrink frame level with lower edges of the side faces, cause the lifted outwardly projecting edge to drop back against the strip at upper regions of the side faces and shrink against and weld to an outer face of the strip around the upper regions of the side faces with the hot air trapped between the side walls and side faces while pressing and shrinking the strip against the side faces of the object as the shrink frame moves into the lower position, the walls laterally closing the chamber between the shrink frame and plate when in and between the upper and lower positions.

2. The method defined in claim 1, wherein the strip is wrapped in overlapping turns around the object starting from a lower end thereof such that each turn overlaps the turn immediately below.

3. The shrink-packaging method defined in claim 1, further comprising the step of:

pressing the plate down onto the cover sheet so as to force out air between the cover sheet and the top face.

4. The shrink-packaging method defined in claim 1, wherein in the upper position the hot air is blown against the side walls of the object below the upper edge regions of the side faces such that the air rises up around the object in the shrinking chamber to the upper edge regions and there heats the outer edges of the cover sheet.

5. The shrink-packaging method defined in claim 1, further comprising the step of:

heating the air to such a temperature as to shrink the strip and outer edges of the cover sheet inward against the side faces.

6. The shrink-packaging method defined in claim 1, further comprising the step, after starting to blow the hot air against the side faces, of lowering the frame from the upper position to the lower position.

7. The shrink-packaging method defined in claim 6, further comprising the step, after commencement of lowering the frame from the upper position, of:

lifting the press plate upward off the top face while the hot air is blown against the side faces such that the rising hot air is trapped above the cover sheet on the top face to heat the cover sheet.

8. An apparatus for shrink packaging an object having outwardly directed side faces and an upwardly directed top face, the apparatus comprising:

a support for holding the object with the side faces vertical and the top face horizontal;

means for wrapping a strip of thermoplastic film around the side faces of the object such that an upper edge of the strip projects upward past the top face of the object and folds inward onto outer edge regions of the top face of the object;

means for laying a cover sheet of thermoplastic film on the top face of the object over the folded-in upper edge of the strip with outer edges of the cover sheet projecting outward past and hanging down outside the film strip along upper edge regions of the side faces of the object;

a vertically displaceable heat-controlled plate above the upper face and having an outer edge projecting horizontally outward past the side faces of the object;

respective vertically extendable side walls projecting downward from the outer edge of the plate, movable vertically independently of the plate, each spaced horizontally outward from a respective one of the side faces of the object, and forming with the plate a downwardly open and downwardly expandable shrink chamber spacedly surrounding the object;

an annular shrink frame carried on lower ends of the side walls;

means for maintaining the plate at a temperature below a melting point of the cover sheet but sufficient to soften the cover sheet;

means for downwardly moving the heated plate, side walls, and shrink frame from an upper position with the shrink frame level with the upper regions of the side faces toward a lower position with the shrink frame level with a lower edges of the side faces while the walls laterally close a space between the shrink frame and the plate to press the heated plate down against the cover sheet to flatten same and the folded-in upper edge of the strip against the top face while the heated plate softens the cover sheet without welding it to the top face; and means for blowing hot air between the side walls and the side faces while the plate is pressed down against the cover sheet so the hot air is trapped in the shrink chamber between the side walls and the side faces and first lifts the outer edge of the cover lift with the hot air and then as the walls and shrink frame move to the lower position lets the lifted outer edge drop back against and weld to an outer side of the strip around upper regions of the side faces while pressing the strip against the side faces.

* * * * *